United States Patent [19]

Barabas

[11] Patent Number: 4,521,253

[45] **Date of Patent: * Jun. 4, 1985**

[54] RUST REMOVAL PROCESS

[75] Inventor: Eugene S. Barabas, Watchung, N.J.

[73] Assignee: GAF Corporation, Wayne, N.J.

[ * ] Notice: The portion of the term of this patent subsequent to Jan. 3, 2001 has been disclaimed.

[21] Appl. No.: 538,954

[22] PCT Filed: Mar. 24, 1983

[86] PCT No.: PCT/US83/00418

§ 371 Date: Sep. 27, 1983

§ 102(e) Date: Sep. 27, 1983

[87] PCT Pub. No.: WO83/03429

PCT Pub. Date: Oct. 13, 1983

Related U.S. Application Data

[63] Continuation-in-part of Ser. No. 364,000, Mar. 31, 1982, Pat. No. 4,424,079, and a continuation-in-part of Ser. No. 454,127, Dec. 29, 1982, Pat. No. 4,451,296.

[51] Int. Cl.[3] ..... C23G 1/02

[52] U.S. Cl. ..... 134/3; 134/4; 134/41; 252/174.24

[58] Field of Search ..... 134/3, 4, 22.11, 42, 134/41; 252/82, 174.23, 174.24; 427/156, 309, 327, 388.1, 388.2, 388.4, 444

[56] References Cited

U.S. PATENT DOCUMENTS

| | | | |
|---|---|---|---|
| 3,085,916 | 4/1963 | Zimmie et al. | 252/174.24 X |
| 3,277,008 | 10/1966 | Heit | 252/82 |
| 3,696,498 | 10/1972 | Leontaritis et al. | 29/424 |
| 3,793,222 | 2/1974 | Haschke et al. | 252/174.24 X |
| 3,922,394 | 11/1975 | Lozier | 427/247 |
| 4,200,671 | 4/1980 | Krajewski et al. | 427/154 |
| 4,325,744 | 4/1982 | Panayappan et al. | 134/4 |
| 4,351,673 | 9/1982 | Lawson | 134/3 |
| 4,424,079 | 1/1984 | Barabas | 134/4 |

*Primary Examiner*—Marc L. Caroff

*Attorney, Agent, or Firm*—Joshua J. Ward

[57] ABSTRACT

Rust is removed from metal surfaces by applying a coating of an aqueous solution of copolymer of maleic acid and monomer. The rust becomes incorporated into the coating during drying and the coating detaches itself from the metal surface without the necessity of peeling or otherwise mechanically removing the rust laden coating.

15 Claims, No Drawings

RUST REMOVAL PROCESS

RELATED APPLICATION

This is a continuation-in-part of application Ser. No. 364,000, filed Mar. 31, 1922, now U.S. Pat. No. 4,424,079, and application Ser. No. 454,127, filed Dec. 29, 1982, now U.S. Pat. No. 4,451,296.

FIELD OF THE INVENTION

The invention relates to removal of rust from metal surfaces.

BACKGROUND OF THE INVENTION

Adequate removal of rust from metal surfaces in preparation for the application of paint or other protective coatings is a long standing problem. Mechanical cleaning techniques such as sand blasting, wire brush scrubbing, etc. are messy and time consuming. Previous attempts to chemically clean rusty surfaces have not been entirely satisfactory.

One particularly difficult type of metal surfaces to clean is the irregular surfaces found on ships, i.e., high-temperature valves, pipes, and the like. Frequently, the only cleaning method feasible is the lengthy and tiresome process of wire brushing the surface to be cleaned and then subsequently applying a solution of a wetting agent mixed with a cleaning agent to the metal surface. Such a technique suffers from the difficulty of keeping the cleaning fluid in contact with the surface to be cleaned, such as overhead objects, as well as the subsequent disposal of liquid wastes. Additionally, these solutions are often toxic, non-economical, and require large volumes of water for washing purposes.

Previous attempts to chemically remove rust have involved the use of chemicals such as inhibited hydrochloric acid, ethylenediaminetetraacetic acid (EDTA), EDTA/citric acid, etc. More recently it has been suggested that a paste of water-soluble polymer such as polyvinylpyrrolidone (PVP) and a chelating agent such as EDTA be coated onto a rusty metal surface to be cleaned. After application the paste is said to harden into a thick crust which encapsulates the rust and may be peeled from the cleaned surface and disposed of as solid waste. This process is more fully described in U.S. Pat. No. 4,325,744.

SUMMARY OF THE INVENTION

The invention is a process for removing rust from a rusty metal surface which comprises:

(a) applying to said rusty surface a layer of rust removal coating composition consisting essentially of an aqueous solution or dispersion of water soluble or water dispersible copolymer of maleic acid and unsaturated monomer; and (b) allowing said layer of coating composition to dry whereby rust becomes incorporated into said layer and the layer containing the rust detaches itself from the surface.

Suitable copolymers for use in practicing the invention include but are not limited to copolymers of maleic acid with one or more monomers of the formulas $$CH_2{=}\overset{\overset{\displaystyle R}{|}}{C}R_1 \quad \text{or} \quad CH_2{=}CR_3CH_2R_4$$

where R is H, $CH_3$ or $C_2H_5$;

$R_1$ is H, $-CH_3$, $-COOR_2$, $-CN$, $-OCOR_2$, $-CON(R)_2$,

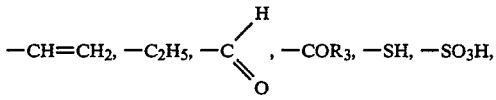

$-CH{=}CH_2$, $-C_2H_5$, $-C$, $-COR_3$, $-SH$, $-SO_3H$,

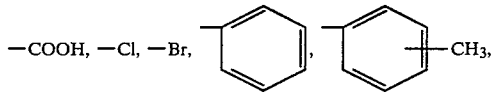

$-COOH$, $-Cl$, $-Br$, $-CH_3$,

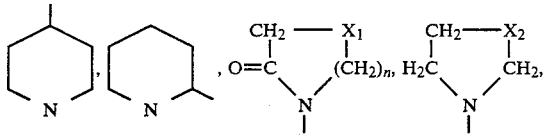

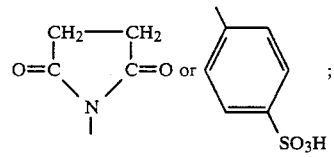

$R_2$ is $-CH_2$ or $-C_2H_5$;

$R_3$ is H, $-CH_3$ or $-\overset{\overset{\displaystyle CH_3}{|}}{\underset{\underset{\displaystyle CH_3}{|}}{C}}-CH_3$;

$R_4$ is $-OCOR_2$ or $-NHR_5$;
$R_5$ is H or $-CH{-}CH{=}CH_2$;
n is 1 to 4;
$X_1$ is $-CH_2$ or $-O$; and
$X_2$ is $-O$ or $-NH$

DETAILED DESCRIPTION OF THE INVENTION

Water soluble or water dispersible copolymers suitable for use in the process of the invention are copolymers of maleic acid with one or more unsaturated monomers. Such maleic acid copolymers may be formed by hydrolysis of precursor copolymer of maleic anhydride and one or more unsaturated monomers capable of forming water soluble or water dispersible copolymers of maleic acid. The precursor copolymer may be obtained by any of the conventional methods known for making such copolymers as exemplified for instance in U.S. Pat. Nos. 3,553,183, 3,794,622 and 3,933,763 the disclosures of which are incorporated herein by reference.

Suiable monomers for copolymerization with maleic anhydride precursor to form copolymers for use in the invention include for instance:

| Formula | Name |
|---|---|
| 1. $CH_2{=}CH_2$ | ethylene |
| 2. $CH_2{=}CHCH_3$ | propylene |
| 3. $CH_2{=}CH{-}CH{=}CH_2$ | butadiene |
| 4. $CH_2{=}CHC_2H_5$ | butylene |
| 5. $CH_2{=}CHCOOCH_3$ | methylacrylate |
| 6. $CH_2{=}CHCOOC_2H_5$ | ethylacrylate |

-continued

| Formula | Name |
|---|---|
| 7. $CH_2{=}CHCOOC_2H_5N(CH_3)_2$ | dimethylamino-ethylacrylate |
| 8. $CH_2{=}CHCN$ | acrylonitrile |
| 9. $CH_2{=}CHOCOCH_3$ | vinylacetate |
| 10. $CH_2{=}CHOCOC_2H_5$ | vinylpropionate |
| 11. $CH_2{=}CHCHO$ | acrolein |
| 12. $CH_2{=}CHOCH_3$ | vinylmethylether |
| 13. $CH_2{=}CHOC_2H_5$ | vinylethylether |
| 14. $CH_2{=}CHOC_2H_5N(CH_3)_2$ | dimethylamino-ethylvinylether |
| 15. $CH_2{=}CHCONH_2$ | acrylamide |
| 16. $CH_2{=}CHSCH_3$ | vinylmethylthioether |
| 17. $CH_2{=}CHSC_2H_5$ | vinylethylthioether |
| 18. $CH_2{=}CHNCO$ | vinylisocyanate |
| 19. $CH_2{=}CHCOCH_3$ | vinylmethylketone |
| 20. $CH_2{=}CHCOC(CH_3)_3$ | vinylisopropylketone |
| 21. $CH_2{=}CHCl$ | vinyl chloride |
| 22. $CH_2{=}CHBr$ | vinyl bromide |
| 23. $CH_2{=}CHSO_3H$ | vinylsulfonic acid |
| 24. $CH_2{=}CHSH$ | vinylsulfide |
| 25. 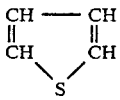 | vinylthiophene |
| 26. 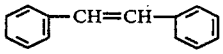 | sillbene |
| 27. 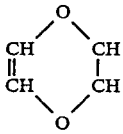 | dioxene |
| 28. 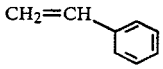 | styrene |
| 29. 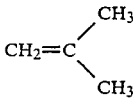 | isobutylene |
| 30. 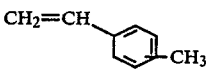 | vinyltoluene |
| 31. 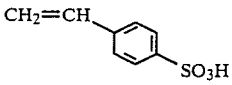 | vinylsulfonic acid |
| 32. 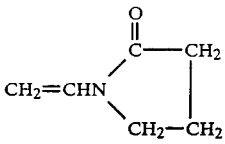 | vinylpyrrolidinone |
| 33. 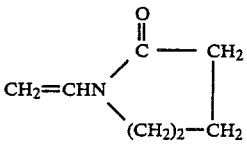 | vinylvalerolactam |

-continued

| Formula | Name |
|---|---|
| 34. 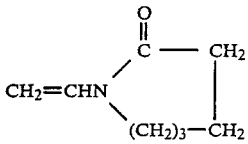 | vinylcaprolactam |
| 35. 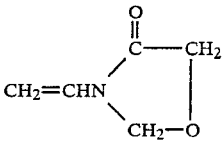 | vinyloxazolidinone |
| 36. 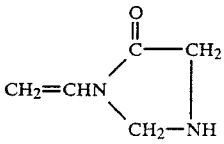 | vinylimidazolinone |
| 37. 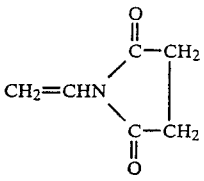 | vinylmaleiimide |
| 38. 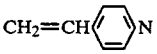 | 4-vinylpyridine |
| 39. 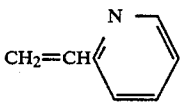 | 2-vinylpyridine |
| 40. $CH_2{=}C(CH_3)COOH$ | methacrylic acid |
| 41. $CH_2{=}CHCOOH$ | acrylic acid |
| 42. $CH_2{=}C(CH_3)COOCH_2$ | methylmethacrylate |
| 43. $CH_2{=}C(CH_3)COOC_2H_5$ | ethylmethacrylate |
| 44. $CH_2{=}C(CH_3)COOC_2H_5N(CH_3)_2$ | dimethylamino-ethylmethacrylate |
| 45. $CH_2{=}C(CH_3)CN$ | methacrylonitrile |
| 46. $CH_2{=}C(CH_3)OCOCH_3$ | methallylacetate |
| 47. $CH_2{=}C(CH_3)OCOC_2H_5$ | methallylpropionate |
| 48. $CH_2{=}C(CH_3)CHO$ | methacrolein |

-continued

| Formula | Name |
|---|---|
| 49. $CH_2{=}C(CH_3){-}OCH_3$ | isopropenylmethylether |
| 50. $CH_2{=}C(CH_3){-}OC_2H_5$ | isopropenylethylether |
| 51. $CH_2{=}C(CH_3){-}OC_2H_5N(CH_3)_2$ | isopropenyldimethyl-aminoether |
| 52. $CH_2{=}C(CH_3){-}CONH_2$ | methacrylamide |
| 53. $CH_2{=}C(CH_3){-}SCH_3$ | isopropenylmethyl-thioether |
| 54. $CH_2{=}C(CH_3){-}SC_2H_5$ | isopropenylethylthio-ether |
| 55. $CH_2{=}C(CH_3){-}NCO$ | isopropenylisocyanate |
| 56. $CH_2{=}C(CH_3){-}COCH_3$ | isopropenyl methylketone |
| 57. $CH_2{=}C(CH_3){-}COC(CH_3)_3$ | isopropenyl-t-butyl-ketone |
| 58. 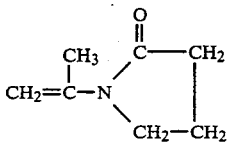 | isopropenylpyrrolidinone |
| 59. 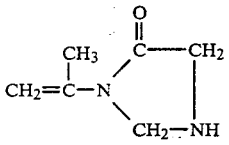 | isopropenylimid-azolidinone |
| 60. 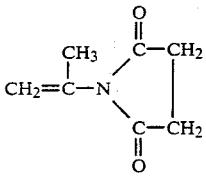 | isopropenyl-maleiimide |
| 61. 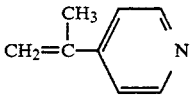 | 4-isopropenyl-pyridine |
| 62. 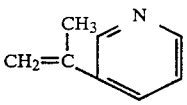 | 2-isopropenyl-pyridine |
| 63. $CH_2{=}CHCH_2OCOCH_3$ | allylacetate |
| 64. $CH_3CH{=}CHOCOC_2H_5$ | ethylcrotonate |
| 65. $CH_2{=}CHCH_2NH_2$ | allylamine |
| 66. $CH_2{=}C(CH_3){-}CH_2OCOCH_3$ | methallylacetate |

-continued

| Formula | Name |
|---|---|
| 67. $CH_2{=}C(CH_3){-}CH_2NH_2$ | methallylamine |
| 68. 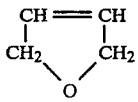 | 2,3 dihydrofurane |
| 69. 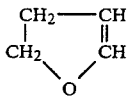 | 2,5 dihydrofurane |
| 70. 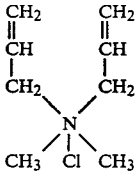 | dimethyldiallyl-ammonium chloride |

Precursors of copolymers for use in the process of the invention are maleic anhydride copolymers of the general formula

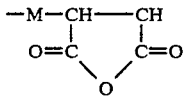

where M represents one or more monomers. As mentioned the copolymer is used in the form of an aqueous solution. The copolymer as used in the aqueous solution is hydrolyzed and has the general formula

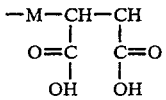

where M is as described above.

In practicing the invention the maleic acid is used in the form of an aqueous solution generally containing between about 5 and about 60 weight percent (wt %) copolymer and between about 40 and about 95 wt% water. Such solutions may be formed in any suitable manner such as by mixing the copolymer or precursor copolymer with water by stirring or shaking at room temperature and may be used at varying degrees of neutralization such as in a pH range of about 1–7. Conventional organic or inorganic bases may be used to obtain the desired degree of neutralization. The molecular weight of the maleic acid copolymer used may vary widely. Copolymers having K values between about 20 and about 120 or even higher are for instance generally considered suitable for use in practicing the invention.

It will be appreciated that viscosities obtainable within the preferred limits of water content and K value mentioned above may vary widely, the major variable being the amount of water used. The choice of preferred viscosity for rust removal coating compositions for use in the invention will depend largely upon the intended use. For instance for lightly rusted metal surfaces it may be desired to have a relatively thin liquid coating having a viscosity for instance between about 50 and about 50,000 centipoises (cps) such that the coating can be sprayed on or applied with an ordinary paint brush to a thickness between about 0.01 and about 5 mm. For many applications a relatively high viscosity, paste like coating having a viscosity e.g. between about 10,000 and about 250,000 cps may be desired. Such high viscosity coatings may be easily applied even to overhead surfaces e.g. with a putty knife to form coatings of between about 0.5 and about 20 mm or thicker as desired. The paste like form of the copolymer is especially preferable for application to vertical or overhead surfaces where excessive dripping and flowing of the coating after it is applied to the rusted surface would be undesirable.

If desired the viscosity of coating composition for use in the invention may be increased by including in the composition one or more thickening agents in an amount sufficient to increase the viscosity of the composition to the desired value. For this purpose any conventional thickening agents may be used. When used, thickening agents are frequently used in amounts between about 0.1 and about 10 wt % based on total composition. Suitable thickening agents include for instance: natural or synthetic gums such as xanthan, guar, tragacanth, etc.; cellulose derivatives such as hydroxyethyl cellulose etc. Crosslinked interpolymers of the type described in U.S. Pat. No. 3,448,088, the disclosure of which is incorporated herein by reference, are for instance suitable for this purpose.

In practicing the invention it is generally preferred that the coating composition be applied to the rusty metal surface in a thickness of at least about 0.01 mm, more preferably between about 0.5 and about 2 mm. For heavily rusted surfaces it is preferred that the coating be at least about 1 mm thick to ensure suitably complete removal of rust. Coatings applied in the preferred thicknesses mentioned will, under most normal conditions, dry in periods of time between about 0.5 and about 8 hours. Drying time depends upon a number of conditions including primarily coating thickness and viscosity and atmospheric conditions, especially temperature and humidity. If coatings are allowed to dry completely the rust becomes incorporated in the coating (assuming the coating is sufficiently thick for the amount of rust on the surface of the metal) and the dried coating containing the rust becomes detached from the metal surface in the form of flakes or small strips which may remove themselves from the metal surface or may be easily removed such as by brushing or blowing. In the case of overhead surfaces the self-removing feature is such that it is usually sufficient merely to allow the flakes or strips of dried coating to fall from the surface of the metal under the influence of gravity. The self-removing property of the copolymers used is relatively insensitive with respect to variations in temperature and humidity. Under some conditions, such as when the coating is not allowed to dry completely, it may be necessary to brush or scrape the surface to completely remove the rust laden coating. While the exact mechanism by which the rust is incorporated into the coating and becomes detached from the metal surface is not fully understood, it is believed that the coating composition soaks into and complexes the rust with the film forming properties of the coating being such that the coating containing rust tends as it becomes completely dry to detach spontaneously from the metal surface.

The process of the present invention is especially useful where substantially complete removal of rust is desired without leaving any residue of the rust in the air or on surrounding surfaces. The process of the invention may for instance be used to remove rust which is either radioactive or contaminated with radioactive particles without leaving any residual contamination on the previously rusted surfaces or in the air. Further, the tendency of the dried coating to be self removing in the form of flakes or strips rather than smaller particles facilitates complete removal of the dried coating containing the rust without the residual contamination which might otherwise be present due to incomplete removal of small particles from the area.

The following examples are intended to illustrate the invention without limiting the scope thereof. The material identified in the examples as VAZO 52 is azo-bis-dimethyl valeronitrile initiator available from duPont.

EXAMPLE 1

A coating composition suitable for use in practicing the invention was prepared by the following procedure:

Into a clean, dry 1 gallon autoclave (Autoclave A) were charged 2088.0 g methylene chloride, and 258.7 g maleic anhydride.

Autoclave A was purged three times with nitrogen by bringing up pressure to 25 psig and releasing to 2 psig. Then the contents of Autoclave A were stirred, until the solution was clear.

Into a dry, clean 1 gallon autoclave (Autoclave B) were charged 720.0 g of the solution in Autoclave A.

366.3 g N-vinyl-2-pyrrolidone, and 4.5 g VAZO 52 initiator dissolved in 100 g methylene chloride.

Autoclave B was thoroughly purged with nitrogen and then heated to 45° C. with 80 RPM agitation. The contents of Autoclave B was then added over a 2½ hour period of time. When addition was completed, the system was stirred for an additional 2½ hours, while the temperature was allowed to rise to 48° C.

After that 0.5 g VAZO 52 dissolved in 10 g methylene chloride was added and stirring was continued for further 3 hours. After this period a sample was taken and tested for unreacted maleic anhydride with triphenyl phosphine indicator paper. The steps of adding initiator and stirring for 3 hours were repeated until the test was negative.

The polymer was then discharged through a filter and the filter-cake was washed three times with 500 ml methylene chloride.

The solid polymer was air dried for 1 hour. Then it was placed in a vacuum oven for 5 hours at 30 mm and 65° C.

The dried polymer had the following properties:

K-Value: 30.1

Conversion: 51.44%

Acid Number: 524.0

% Nitrogen: 6.23%

A solid sample of the dried polymer was added to water in such a way that it gave a 35% solution. The jar was shaken at room temperature, until the solution was clear. The Brookfield viscosity of the 35% solution of polymer was 760 centipoises (cps) and the solution had a pH of 1.8.

A 28 gauge sheet of iron, the surface of which was covered with rust, was placed flat on a bench, and a coating of copolymer 1.27 mm thick was applied using a doctor knife. The width of the coating was 2½ inches.

The coated metal was allowed to stand overnight at about 23° C. and 45% relative humidity. Next morning, the brittle film separated completely from the metal substrate in strips about 1–2 mm wide. The surface of the metal was by visual inspection free of rust. The rust was firmly embedded in the separated film.

EXAMPLE 2

Another coating composition suitable for use in the process of the invention was prepared as follows:

Into a dry, clean 1 liter reaction kettle were charged under a blanket of nitrogen:

303.0 g dry toluene
88.2 g maleic anhydride and
124.9 g N-vinyl-2-pyrrolidone

The system was heated to 55° C., then 84.0 g of a 2.5% solution of VAZO 52 in toluene was added. The system was stirred at 55° C. for 3 hours, then 16.8 of a 2.5% VAZO 52 solution was added. The stirring was continued for 1 more hour and a sample was taken. The sample was tested for unreacted maleic anhydride with triphenyl phosphine indicator paper. The addition of 16.8 g of VAZO 52 solution was repeated hourly 3 more times. After that the system was cooled to room temperature and discharged through a filter. The filtercake was washed 3 times with 100 ml dry heptane.

The solid polymer was air dried for 1 hour, then it was placed in a vacuum oven for 5 hours at 30 mm and 65° C. The dried polymer had the following properties.

Conversion: 86.61%
K-Value: 40.6
Acid Number: 495.22
Nitrogen: 6.80%

The solid sample was added to water in such a way that it gave a 35% solution. The jar was shaken at room temperature, until the solution was clear. The Brookfield viscosity of the 35% solution of polymer was 4450 cps and the solution had a pH of 1.8.

A 28 gauge sheet of iron, the surface of which was covered with rust, was placed flat on a bench and was coated with a 1.27 mm thick layer a 35% water solution of the copolymer, using doctor knife. The width of the coating was 2½ inches.

The coated metal was allowed to stand overnight at about 23° C. and 40% relative humidity. Next morning, the brittle film separated completely from the metal substrate in strips about 1–2 mm wide. The surface of the metal was by visual inspection free of rust. The rust was firmly embedded in the separated film.

EXAMPLE 3

Eighteen (18) grams of commercial copolymer poly(-methylvinylether-co-maleic anhydride)-Gantrez AN 139, a product of GAF Corporation, was placed in a glass jar with screw-cap and 80 grams distilled water was added. The jar was placed on a shaker and was shaken at room temperature, until a clear solution was obtained, indicating complete hydrolysis.

The polymer solution was analyzed with the following results:

Solids: 20.0%
K-Value: 107.8
Acid Number: 643.43 (Theory: 648.56)
pH: 2.9
Brookfield Viscosity: 9100 cps (20%)

A 28 gauge sheet of black iron, the surface of which was covered with rust, was placed flat on a bench, and was coated with a 1.27 mm thick, 63 mm wide layer of the copolymer solution, using a doctor knife.

The coated metal was allowed to stand overnight. Next morning the brittle film was found to be separated completely from the metal substrate with the rust firmly embedded in the separated film. The surface of the metal was by visual inspection free of rust.

EXAMPLE 4

Thirty-five (35) grams of commercial poly(ethylene-co-maleic anhydride)-EMA 21, a product of Monsanto Chemical Company—was placed in a screw-cap jar and 65 grams distilled water was added. The jar was placed on a shaker and the mixture was shaken at room temperature, until clear solution was obtained.

The polymer solution was analyzed with the following results:

Solids: 33.34%
K-Value: 56.6
Acid Number: 972.44 (Theory: 977.60)
pH: 2.8
Brookfield Viscosity: 6920 cps (as is)

A 28 gauge sheet of iron, the surface of which was covered with rust, was placed flat on a bench, and was coated with a 1.27 mm thick, 63 mm wide layer of the copolymer solution, using a doctor knife.

The coated metal was allowed to stand overnight. Next morning the brittle film was found to be separated completely from the metal with the rust firmly embedded in the separated film. The surface of the metal was by visual inspection free of rust.

EXAMPLE 5

A two liter kettle, equipped with mechanical stirrer, reflux condenser, gas inlet tube and thermometer was purged thoroughly with nitrogen. To the kettle were charged in the following sequence:

840.0 g toluene
294.0 g maleic anhydride
64.9 g vinyl acetate, and
3.0 g VAZO 52

The system was heated to 65° C. and this temperature was held for 15 minutes. After that, 193.5 g vinylacetate was placed in a dropping funnel and was added to the reaction mixture in 1 hour while maintaining the temperature. After the addition was over, the temperature was held for 1 more hour, then 0.5 g VAZO 52 was added. The temperature was kept at 65° C. and the addition of 0.5 g VAZO 52 was repeated twice at one hour intervals, until the test gave negative results for maleic anhydride.

The polymer slurry was filtered, then the cake was reslurried in 600 ml methylene chloride. The slurry was agitated for ½ hour at room temperature and then it was filtered. The filtered polymer was washed three times with 100 ml methylene chloride, then it was dried in a vacuum at 80° C.

The analysis of the polymer was as follows:

Solids: 98.58%
Acid Number: 604.88 (Theory: 601.12)

Thirty-five (35) grams of this copolymer was then placed in a glass jar with screw-cap and 65 grams distilled water was added. The jar was placed on a shaker and the mixture was shaken at room temperature until a clear solution was obtained indicating complete hydrolysis. The polymer solution was analyzed with the following results:

Solids: 34.97%
K-Value: 38.1
Acid Number: 210.28
Brookfield Viscosity: 3450 cps
Relative Viscosity (1%): 1.3832

A 28 gauge sheet of iron, the surface of which was covered with rust, was placed flat on a bench and was coated with a 1.27 mm thick 63 mm wide layer of the copolymer solution using a doctor knife.

The coated metal was allowed to stand overnight. Next morning the brittle film was found to be separated completely from the metal substrate with the rust firmly embedded in the separated film. The surface of the metal was by visual inspection free of rust.

While the invention has been described above with respect to preferred embodiments thereof, it will be understood by those skilled in the art that various changes and modifications may be made without departing from the spirit or scope of the invention.

What is claimed is:

1. Process for removing rust from a rusty metal surface which compises:
   (a) applying to said rusty surface a layer of rust removal coating composition consisting essentially of an aqueous solution or dispersion of water soluble or water dispersible copolymer of maleic acid and unsaturated monomer; and
   (b) allowing said layer of coating composition to dry whereby rust becomes incorporated into said layer and the layer containing the rust detaches itself from the surface.

2. Process of claim 1 wherein the monomer comprises one or more monomers of the formula

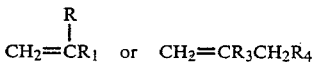

where R is H, $CH_3$ or $C_2H_5$;

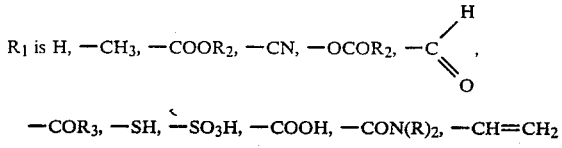

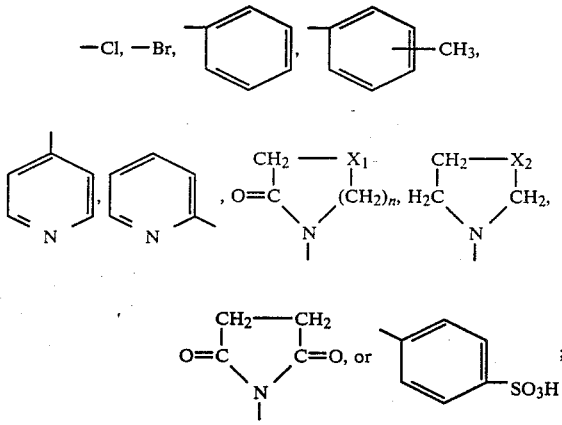

-continued $R_2$ is $-CH_3$ or $-C_2H_5$;

$R_3$ is H, $-CH_3$ or $-\overset{CH_3}{\underset{CH_3}{C}}-CH_3$;

$R_4$ is $-OCOR_2$ or $-NHR_5$;
$R_5$ is H or $-CH-CH=CH_2$;
n is 1 to 4;
$X_1$ is $-CH_2$ or $-O$; and
$X_2$ is $-O$ or $-NH$.

3. Process according to claims 1 or 2 wherein the coating composition contains between about 5 and about 60 wt % copolymer and between about 40 and about 95 wt % water.

4. Process according to claims 1 or 2 wherein the coating composition has a viscosity between about 50 and about 250,000 cps.

5. Process according to claims 1 or 2 wherein the coating composition is applied to the rusty surface in a layer between about 0.01 and about 20 mm thick.

6. Process according to claims 1 or 2 wherein the layer of applied coating composition is allowed to dry for between about 0.5 and about 8 hours.

7. Process according to claim 1 wherein the monomer is of the formula $CH_2=CHR_1$ where $R_1$ represents H, $-CH_3$, $-OCH_3$, $-OC_2H_5$, $-OCOCH_3$ or $-OCOC_2H_5$.

8. Process according to claim 1 wherein the monomer is methylvinyl ether.

9. Process according to claim 2 wherein:
   (a) the coating composition contains between about 5 and about 60 wt % copolymer;
   (b) the coating composition has a viscosity between about 50 and about 250,000 cps; and
   (c) the coating composition is applied to the rusty surface in a layer between about 0.1 and about 20 mm thick.

10. Process for removing rust from a rusty metal surface which comprises:
   (a) applying to said rusty surface a layer between about 0.01 and about 20 mm thick of rust removal coating composition having a viscosity of between about 50 and about 250,000 cps and consisting essentially of an aqueous solution or dispersion containing between about 5 and about 60 wt % of water soluble or water dispersible copolymer of maleic acid and unsaturated monomer; and
   (b) allowing said layer of coating composition to dry whereby rust becomes incorporated into said layer and the layer containing the rust detaches itself from the surface.

11. Process according to claim 10 wherein the monomer is of the formula $CH_2=CHR_1$ where $R_1$ represents H, $-CH_3$, $-OCH_3$, $-OC_2H_5$, $-OCOCH_3$ or $-OCOC_2H_5$.

12. Process according to claim 10 wherein the monomer is methylvinylether.

13. Process according to claim 10 wherein the monomer is ethylene.

14. Process according to claim 10 wherein the monomer is vinyl acetate.

15. Process according to claim 10 wherein the layer of applied coating composition is allowed to dry for between about 0.5 and about 8 hours.

* * * * *